US005368774A

United States Patent [19]

Borgard et al.

[11] Patent Number: 5,368,774

[45] Date of Patent: Nov. 29, 1994

[54] WATER SOLUBLE CORROSION INHIBITOR EFFECTIVE AGAINST CORROSION BY CARBON DIOXIDE

[75] Inventors: Bradley G. Borgard, Houston; Jack B. Harrell, Jr., Friendswood; John Link, Humble, all of Tex.

[73] Assignee: Baker Hughes Incorporated, Houston, Tex.

[21] Appl. No.: 99,774

[22] Filed: Jul. 30, 1993

Related U.S. Application Data

[63] Continuation of Ser. No. 922,149, Jul. 30, 1992, abandoned.

[51] Int. Cl.[5] ..... C23F 11/14

[52] U.S. Cl. ..... 252/391; 252/394; 422/16; 208/47; 208/97; 208/177

[58] Field of Search ..... 252/391, 394; 422/16; 208/47, 97, 177

[56] References Cited

U.S. PATENT DOCUMENTS

| | | | |
|---|---|---|---|
| 2,723,232 | 11/1955 | Scott | 252/391 |
| 2,797,199 | 6/1957 | Chittum | 252/391 |
| 3,121,091 | 2/1964 | Green | 252/391 |
| 3,260,538 | 7/1966 | Gardner | 252/391 |
| 3,392,192 | 7/1968 | Malec | 252/391 |
| 3,619,125 | 11/1971 | Powancher | 252/391 |
| 4,071,746 | 1/1978 | Quinlan | 252/390 |
| 4,100,099 | 7/1978 | Asperger et al. | 252/390 |
| 4,102,804 | 7/1978 | Clouse et al. | 252/391 |
| 4,557,838 | 12/1985 | Nichols et al. | 269/214 |
| 4,637,899 | 1/1987 | Kennedy, Jr. | 252/391 |
| 5,000,873 | 3/1991 | Fisk et al. | 252/390 |

*Primary Examiner*—Robert L. Stoll
*Assistant Examiner*—Valerie D. Fee
*Attorney, Agent, or Firm*—Rosenblatt & Associates

[57] ABSTRACT

The present invention provides compositions and methods which are effective to prevent corrosion of metal surfaces involved in refining solutions having relatively high partial pressures of carbon dioxide. The compositions of the present invention comprise mixtures of a pyridinium quaternary salt and an organic compound, such as thiourea, which contains at least one sulfur atom double bonded to a carbon atom. The compositions are added substantially continuously to the solution to be treated to result in a final concentration of at least about 30 ppm of pyridinium quaternary salt, preferably between about 56–70 ppm, and at least about 5 ppm double bonded sulfur containing compound, preferably between about 10–13 ppm.

15 Claims, No Drawings

WATER SOLUBLE CORROSION INHIBITOR EFFECTIVE AGAINST CORROSION BY CARBON DIOXIDE

This application is a continuation of copending application Ser. No. 07/922,149, filed on Jul. 30, 1992, now abandoned.

TECHNICAL FIELD

The present invention relates to compositions and methods for reducing corrosion of metal surfaces by aqueous acid solutions during refinery operations, particularly corrosion by solutions having relatively high partial pressures of carbon dioxide.

BACKGROUND OF THE INVENTION

Many technical and industrial operations employ aqueous acid solutions which come in contact with metal surfaces. In such operations, the metal surfaces in contact with the acidic solutions generally are corroded by those solutions if preventative measures are not taken.

The types of acidic solutions encountered during refinery operations varies. For example, in many product streams, hydrochloric acid is encountered in the hundreds of parts per million. At such low concentrations, the corrosive activity of the hydrochloric acid may be controlled easily and economically by adding a nuetralizer to the product stream.

Occasionally, a refinery may be required to process crude oil which liberates a high concentration of carbon dioxide when heated, e.g., if carbon dioxide flooding was used to liberate the crude oil, or if the crude oil contains a high concentration of naphthenic acids. When such crude oil is processed, the carbon dioxide levels in the resulting product streams also may be high. As a result, the metal surfaces of the processing equipment may be corroded by the carbonic acid formed when the carbon dioxide dissolves in the solution.

The amount of carbon dioxide present in such situations is much greater than the amount of hydrochloric acid present in most refinery operations. Therefore, because of the volume of neutralizer that would be required, it would not be economically feasible to prevent corrosion by carbonic acid in such situations. Therefore, methods and compositions which would economically and effectively inhibit such corrosion would be highly desirable.

SUMMARY OF THE INVENTION

The present invention provides compositions and methods which economically and effectively prevent the corrosion of metal surfaces by solutions having relatively high partial pressures of carbon dioxide, preferably where the solutions contact the metal surfaces at a high velocity. The compositions of the present invention comprise mixtures of (1) a pyridinium quaternary salt, and (2) an organic compound which contains at least one sulfur atom double bonded to a carbon atom, preferably a thiourea. The foregoing combination inhibits corrosion by carbonic acid if the compositions are substantially continuously maintained in the solution at a total concentration of at least about 30 ppm pyridinium quaternary salt, preferably between about 56–70 ppm, and at least about 5 ppm of double bonded sulfur containing compound, preferably between about 10–13 ppm, at preferable temperature range of between about 38°–66° C. (100°–150° F.).

DETAILED DESCRIPTION OF THE INVENTION

The present invention may be used to protect the equipment used to refine product streams having a relatively high partial pressure of carbon dioxide. For example, the invention may be used to protect: effluent water desalters, sour water handling and treatment systems, sour gas scrubbing units, gas transmission pipelines, glycol dehydration systems, amine absorbers, and other amine units, such as units in which potassium carbonate solutions are used to remove gaseous carbon dioxide from a hydrocarbon stream. Preferably, the present invention is used to treat aqueous solutions found in systems where high velocity has aggravated a carbon dioxide corrosion problem, for example, in refinery atmospheric overhead condenser systems, such as the overhead accumulators attached to various fractionation and vacuum towers, or the heat exchangers used in connection with such towers.

The present invention may be used to treat aqueous solutions having a partial pressure of carbon dioxide between about 0.5 psi to about 20 psi, preferably between about 0.5 to 5 psi. Solutions having the foregoing partial pressures of carbon dioxide may cause substantial corrosion of metal surfaces in processing equipment, particularly if those metal surfaces are comprised of iron-based alloys and/or if those solutions are at a high velocity. For example, a steel surface exposed to a solution having an average partial pressure of carbon dioxide of about 31,026.42 Newtons/$m^3$ (4.5 psi) which is treated at an average temperature of about 82° C. (180° F.) will corrode at approximately 150 mils per year (mpy).

Without imposing theoretical limitations on the present invention, the corrosion of the iron based metal alloys is believed to be effectively inhibited as the result of a synergistic effect produced by the combination of the pyridinium quaternary salt and the organic compound containing the double bonded sulfur atom. The films on the metal formed by using this product are very tenacious and are not removed easily by high velocity fluid streams. In fact, tests show that the films continue to protect the metal surface for more than a week after the corrosion inhibitor containing liquid is removed.

In a preferred embodiment of the present invention, the resulting treated solution should contain a final concentration between about 30–70 ppm of the pyridinium quaternary salt, preferably between about 56–70 ppm, and a final concentration between about 5–13 ppm of the double bonded sulfur containing compound, preferably between about 10–13 ppm. Additional pyridinium quaternary salt and double bonded sulfur compound can be added; however, the use of higher concentrations of these compositions is not necessary to prevent corrosion under typical operating conditions.

The pyridinium quaternary salt and double bonded sulfur compound of the present invention may be dissolved in any fluid which will not interfere with the operation of the present invention. Preferably, purified water, such as deionized water, is used as a solvent. Also, a small amount of alcohol, such as methyl alcohol, may help to solubilize the amine and the double bonded sulfur compound; however, the presence of alcohol is not required for operation of the present invention.

Preferred pyridinium quaternary salts for use in the present invention have the following structure:

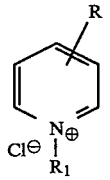

wherein R may be substituted on the pyridine ring at the 2, 3, or 4 position. R preferably is either a hydrogen, or a substituted or unsubstituted alkyl group having three or fewer carbon atoms. Most preferably, R is methyl group. R also may be a substituted or unsubstituted aryl group, alkaryl group, or aralkyl group. Suitable substituents for R would include halides or any other substituents that would not interfere with or sterically hinder the bonding of the heterocyclic nitrogen to the metal surface to be protected.

$R_1$ may be hydrogen, a substituted or unsubstituted alkyl or allyl group, or a substituted or unsubstituted aryl group, alkaryl group, or aralkyl group. Preferably, $R_1$ is either a substituted or unsubstituted methyl group, allyl group, or alkaryl group. Most preferably, $R_1$ is a benzyl group. Suitable substituents for $R_1$ would include halides or any other substituent that would not interfere with the bonding of the heterocyclic nitrogen to the metal surface to be protected.

Preferred sulfur containing compounds for use in the present invention include thioureas, dithiocarbamates, and polydithiocarbamates. Other organic compounds containing sulfur double bonded to a carbon atom having the following structure also may be used:

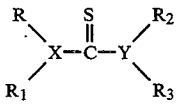

in which X and Y preferably are NH groups, but also may be any combination of a nitrogen, a sulfur and an oxygen. X and Y may be they same substituents, or the may be different substituents. Preferably, R, $R_1$, $R_2$, and $R_3$ all are hydrogens; however, R, $R_1$, $R_2$, and $R_3$ also may be any combination of nothing, a hydrogen, a substituted or unsubstituted cyclic or linear alkyl group, an allyl group, an aryl group, an alkaryl group, or an aralkyl group. Sulfur and oxygen are divalent; therefore, if either X or Y is an oxygen or a sulfur atom, then one of the R groups attached to that oxygen or sulfur group will be nothing. Where R-$R_3$ are hydrocarbons, suitable substituents for R-$R_3$ would include halides or any other substituents that would not interfere with or sterically hinder the reaction of the sulfur containing compound with the pyridinium quaternary salts. In addition, either R or $R_1$ and $R_2$ or $R_3$ may be linear alkyl or allyl groups which connect to form a cyclic compound having the following structure, which otherwise is subject to the definitions of substituents already given:

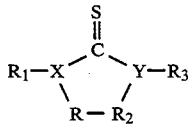

Compounds suitable for use in the present invention generally may be purchased from a number of chemical supply companies, such as Aldrich, 1001 West Saint Paul Avenue, Milwaukee, Wis. 53233. A preferred pyridine composition for use in the present invention is a product known as PB 801, which may be obtained from Lonza, Fair Lawn, N.J., 10410. PB 801 consists of approximately an 80% combination of 1-benzyl-2-picolinium chloride and 1-benzyl-3-picolinium chloride in approximately a 1:2 ratio, and approximately 20% methanol. The PB 801 is combined with thiourea in deionized water and agitated to form a final solution consisting of about 35% PB 801, about 5% thiourea, and about 60% deionized water. The resulting product, which has been given the designation "IPC 2640 Additive," may be obtained from ChemLink Industrial Park 10, 16155 Park Row, Suite 160, Houston, Tex. 77084.

In a preferred method of using the composition of the present invention, the composition is substantially continuously supplied to the solution to be treated using suitable methods known in the art to result in the final concentrations of pyridinium quaternary salt and thiourea described above. If IPC 2640 is used (described in the foregoing paragraph) then the final concentration of IPC 2640 in the final solution should be between about 100–300 ppm, preferably about 250 ppm.

The final concentration of the foregoing compositions will vary depending upon the amount of carbon dioxide in the solution, the temperature of the solution, and the pressure of the solution. The solubility of the compositions increases with increased temperature; therefore, less of the composition will be needed to achieve the desired concentration at higher temperatures. However, the solution should be treated at a temperature that permits the solution to remain in the liquid phase. A preferred range of temperatures for operation of the present invention would be about 38°–66° C. (100°–150° F.).

At higher pressures, the solubility of carbon dioxide increases. Therefore, at higher pressures, more of the composition will be needed to counteract the higher partial pressure of carbon dioxide in the solution. A preferable range of pressures for treatment would be between about 68,947.6–137,895.2 Newtons/$m^3$ (10–20 psi).

EXPERIMENT 1

The purpose of this experiment was to develop a product that could reduce the corrosion rate of steel exposed to high carbon dioxide environments in refinery atmospheric overhead condenser systems. This dynamic system had to be modeled in the laboratory in such a way as to simulate a continuous carbon dioxide vapor pressure Greater than atmospheric pressure in dynamic equilibrium with carbonic acid and carbon dioxide Gas, and the equilibrium of carbonic acid and its ionic species.

$$CO_2+H_2O \rightleftharpoons H_2CO_3 \rightleftharpoons H^+ + HCO_3^{31}$$

A continuous flow of carbon dioxide gas at the partial pressure being simulated was maintained at all times in order to avoid disturbing the delicate equilibrium concentration of acid in the condensate. The corrosion rate of the system versus the carbon dioxide partial pressures similar to that found in the atmospheric overhead condensers then was measured.

EXPERIMENTAL PROCEDURES

Carbon dioxide corrosion was simulated in the laboratory in a high pressure corrosion autoclave which had been adapted for continuous flow carbon dioxide at regulated flows and pressures. The carbon dioxide flows were measured through a calibrated variable area flowmeter, 0–200 SCC/MIN with average flows of 77 SCC/min. The carbon dioxide partial pressure was monitored between 10 and 20 psig. The pressure was held constant using a Go Industries back pressure regulator. The corrosion rate of the autoclave was monitored continuously by a Petrolite 3010 PAIR (Polarization Admittance Instantaneous Rate) technique (known in the art) and displayed on a strip chart recorder versus time.

The 1.5 liter solution of condensate consisted of 1000 ppm sodium sulfate, to provide conductivity, and 100 ppm chloride to reflect process conditions. The condensate was stirred at 300 RPM and was sparged initially with nitrogen for 30 minutes at 70 cc/min to remove oxygen while being heated to the test temperature of about 51.7° C. (125° F.). Carbon dioxide then replaced the nitrogen at the same rate, and the pressure in the autoclave was increased to between 68,947.6–137,895.2 Newtons/m$^3$ (10 and 20 psi). This combination of temperature, pressure and flow provided a baseline corrosion rate between 30–70 mpy. Corrosion inhibitor then was added for a total concentration of 250 ppm, the system was allowed to equilibrate, and the corrosion rate was recorded. The temperature was increased to about 82.2° C. (180° F.) and allowed to reequilibrate, and the corrosion rate again was recorded.

Results

Test 1:

Day 1: Carbon dioxide flow 70 cc/min, 68,947.6 Newtons/m$^3$ (10 psi), about 51.7° C. (125° F.), 300 RPM stirring, baseline corrosion rate 50 mpy.

Day 2: 250 ppm IPC 2640, carbon dioxide 70 cc/min, 68,947.6 Newtons/m$^3$ (10 psi), about 51.7° C. (125° F.), 300 RPM. The equilibrium corrosion rate was 5.5 mpy, providing 89% protection.

Day 3: 250 ppm IPC 2640, carbon dioxide 70 cc/min, 68,947.6 Newtons/m$^3$ (10 psi), about 82.2° C. (180° F.), 300 RPM. The equilibrium corrosion rate was 4 mpy, providing 92% protection.

EXPERIMENT 2

The same procedure was performed using other candidates for comparison.

Results

Test 2:

Day 1: Carbon dioxide flow 70 cc/min, 137,895.2 Newtons/m$^3$ (20 psi), 51.7° C. (125° F.), 300 RPM stirring, baseline corrosion rate 60 mpy.

Day 2: 250 ppm Candidate X, carbon dioxide 70 cc/min, 137,895.2 Newtons/m$^3$ (20 psi), 51.7° C. (125° F.), 300 RPM. The equilibrium corrosion rate was 60 mpy, providing no protection.

Day 3: 250 ppm IPC 2640 was added to the previous test to confirm the effectiveness of IPC 2640 and the ineffectiveness of Candidate X. Carbon dioxide 70 cc/min, 137,895.2 Newtons/m$^3$ (20 psi), 51.7° C. (125° F.), 300 RPM stirring. The equilibrium corrosion rate 8 mpy 24 hours later, provided 87% protection.

CONCLUSIONS FROM EXPERIMENTS 1 and 2

The laboratory continuous flow corrosion vessel worked very well. The carbon dioxide corrosion rate was very reproducible for identical conditions. The gas flows and pressures were easy to control and the corrosion rate was easy to monitor with the Petrolite 3010 PAIR corrosion monitoring equipment.

IPC 2640 worked very well, providing protection of 86% at about 51.7° C. (125° F.) and 92% at 82.2° C. (180° F.). This 90% protection level was confirmed in Experiment No. 2, while at the same time determining the ineffectiveness of Candidate X for carbon dioxide corrosion inhibition. The effectiveness of IPC 2640 also was confirmed by testing comparing the results using IPC 2640 to two products used for hot deep gas wells with carbon dioxide corrosion products. The results using IPC 2640 were comparable.

EXPERIMENT 3

EXPERIMENTAL PROCEDURES

The active ingredients in IPC 2640 are an alkyl pyridinium quaternary salt (benzyl picolinium chloride) and thiourea. It is believed that the reaction products of these two ingredients are benzyl isothiouronium chloride and alkyl pyridine. The following experiments were designed to measure the effect that each of these constituents had in inhibiting corrosion. The validity of the tests was substantiated by other tests comparing IPC 2640 to two products used to control carbon dioxide corrosion in deep hot wells were used as controls. The results using IPC 2640 were comparable.

Test 1:

Day 1: Carbon dioxide flow 70 cc/min, 68,947.6 Newtons/m$^3$ (10 psi), 51.7° C. (125 F.), 300 RPM stirring, baseline corrosion rate 50 mpy.

Day 2: 250 ppm IPC 2640, carbon dioxide 70 cc/min, 68,947.6 Newtons/m$^3$ (10 psi), 51.7° C. (125° F.), 300 RPM. The equilibrium corrosion rate was 5.5 mpy, providing 89% protection.

Day 3: 250 ppm IPC 2640, carbon dioxide 70 cc/min, 68,947.6 Newtons/m$^3$ (10 psi), about 82.2° C. (180° F.), 300 RPM.

Test 2:

Day 1:

Carbon dioxide flow 70 cc/min, 68,947.6 Newtons/m$^3$ (10 psi), 51.7° C. (125° F.), 300 RPM stirring. Baseline corrosion rate 40 mpy.

250 ppm IPC 2640, carbon dioxide 70 cc/min, 68,947.6 Newtons/m$^3$ (10 psi), 51.7° C. (125° F.), 300 RPM stirring. The equilibrium corrosion rate 2 mpy, providing 95% protection.

Test 3:

Day 1: Carbon dioxide flow 70cc/min, 68,947.6 Newtons/m$^3$ (10 psi), 51.7° C. (125° F.), 300 RPM stirring. Baseline corrosion rate 45 mpy.

Day 2:

250 ppm 5% thiourea, carbon dioxide 70 cc/min, 68,947.6 Newtons/m$^3$ (10 psi), 51.7° C. (125° F.), 300 RPM stirring. The equilibrium corrosion rate 40 mpy, providing 10% protection.

250 ppm 35% OFC 1116, carbon dioxide up cc/min, 68,947.6 Newtons/m$^3$ (10 psi), 51.7° C. (125° F.), 300 RPM stirring. The equilibrium corrosion rate 2 mpy, providing 95% protection.

Test 4:

Day 1: Carbon dioxide flow 70cc/min, 68,947.6 Newtons/m$^3$ (10 psi), 51.7° C. (125° F.), 300 RPM stirring. Baseline corrosion rate 30 mpy.

Day 2:

250 ppm 35% OFC 1116, an exemplary pyridinium quaternary salt, which may be obtained from the Chem-Link Division of Baker Performance Chemicals, Houston, Tex, carbon dioxide 70 cc/min, 68,947.6 Newtons/m$^3$ (10 psi), 51.7° C. (125° F.), 300 RPM stirring. The equilibrium corrosion rate 12 mpy, providing 60% protection.

250 ppm 5% thiourea, carbon dioxide 70 cc/min, 68,947.6 Newtons/m$^3$ (10 psi), 51.7° C. (125° F.), 300 RPM stirring. The equilibrium corrosion rate 2 mpy, providing 93% protection.

Test 5:

Day 1: Carbon dioxide flow 70 cc/min, 68,947.6 Newtons/m$^3$ (10 psi), 51.7° C. (125° F.), 300 RPM stirring. Baseline corrosion rate 55 mpy.

Day 2:

250 ppm 10% active benzyl isothiouronium chloride, carbon dioxide 70 cc/min, 68,947.6 Newtons/m$^3$ (10 psi), 51.7° C. (125° F.), 300 RPM stirring. The equilibrium corrosion rate 12 mpy, providing 78% protection.

Test 6:

Day 1:

Carbon dioxide flow 70 cc/min, 68,947.6 Newtons/m$^3$ (10 psi), 51.7° C. (125° F.), 300 RPM stirring. Baseline corrosion rate 55 mpy.

Day 2: 700 ppm 10% active benzyl isothiouronium chloride (70 ppm active), carbon dioxide 70 cc/min, 68,947.6 Newtons/m$^3$ (10 psi), 51.7° C. (125° F.), 300 RPM stirring. The equilibrium corrosion rate 16 mpy, providing 71% protection.

Day 3: 70 ppm 100% alkyl pyridine (70 ppm active), carbon dioxide 70 cc/min, 68,947.6 Newtons/m$^3$ (10 psi), 51.7° C. (125° F.), 300 RPM stirring. The equilibrium corrosion rate 8 mpy, providing 85% protection.

Test 7:

Day 1: Carbon dioxide flow 70 cc/min, 68,947.6 Newtons/m$^3$ (10 psi), 51.7° C. (125° F.), 300 RPM stirring. Baseline corrosion rate 60 mpy.

Day 2: 250 ppm 28% alkyl pyridine (70 ppm active), carbon dioxide 70 cc/min, 68,947.6 Newtons/m$^3$ (10 psi), 51.7° C. (125° F.), 300 RPM stirring. The equilibrium corrosion rate 50 mpy, providing 20% protection.

Day 3: 700 ppm 10% benzyl isothiouronium chloride (70 ppm active), carbon dioxide 70 cc/min, 68,947.6 Newtons/m$^3$ (10 psi), 51.7° C. (125° F.), 300 RPM stirring. The equilibrium corrosion rate 20 mpy, providing 67% protection.

Results

The protection provided by IPC 2640, per se, was 86% at 51.7° C. (125° F.) and 92% at about 82.2° C. (180° F.). The synergistic effects of the components of IPC 2640 show that the inhibitor base (35% of product) provides approximately 60% protection; the thiourea (5% of product) provides about 10% protection; but, the combination (40% of product) provides about 95% protection—greater than the sum of the two independent ingredients. This result was confirmed by test #5-6, in which it was demonstrated that the following reaction products of benzyl picolinium chloride and thiourea had the following effects: benzyl isothiouronium chloride provided 71% protection, and alkyl pyridine provided 20% protection. Therefore, the corrosion protection is apparently provided by an equilibrium mixture of these products.

The synergistic properties of the components of IPC 2640 demonstrate that the corrosion protection is not due to just one component, and is not an additive effect of the individual components. 250 ppm of 5% thiourea (12.5 ppm active) showed 10% protection. When 250 ppm of the 35% 1116 base is added (70 ppm active) the corrosion protection increased to 95%. Conversely, when the experiment is run when the base is added first, 250 ppm of 35% 1116 base, the benzyl picolinium chloride provided only 60% protection. When the 250 ppm of 5% thiourea is added the protection increased to 93%. In this case, the thiourea provides 33% of the protection. This shows a synergistic effect of the two compounds, the sum of the protection of the parts being less than the protection of the whole. Without limiting the present invention, it is likely that the corrosion protection is due to an equilibrium mixture of these products.

One of skill in the art will appreciate that many modifications may be made to the embodiments described herein and explained in the accompanying figures without departing from the spirit of the present invention. Accordingly, the embodiments described herein are illustrative only and are not intended to limit the scope of the present invention.

We claim:

1. A solution in a hydrocarbon refinery unit comprising:

a product stream, at least a portion of which has a highly turbulent velocity, wherein said product stream comprises;

dissolved carbon dioxide; and a composition for inhibiting corrosion of metal surfaces in said hydrocarbon refinery unit by said product stream, said composition comprising a ratio of about 6:1 of a pyridinium quaternary salt and an organic sulfur containing compound, said pyridinium quaternary salt having the following composition:

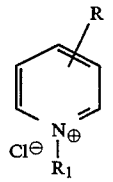

wherein

R is a methyl group substituted at the 2 or 3 position; and $R_1$ is selected from the group consisting of a methyl group, an allyl group, or an alkaryl group, and wherein said organic sulfur containing compound has the following structure:

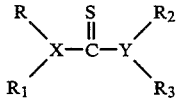

wherein

X and Y are selected from the group consisting of nitrogen, sulfur, and oxygen;

R, $R_1$, $R_2$ and $R_3$ are selected from the group consisting of a hydrogen, a cyclic or linear alkyl group, an allyl group, an aryl group, an alkaryl group, or an aralkyl group, provided that, when X and/or Y is oxygen or sulfur, each of said oxygen or sulfur has only one of said R groups.

2. The composition of claim 1 wherein $R_1$ is a benzyl group in said pyridinium quaternary salt.

3. The composition of claim 1 wherein said organic sulfur containing compound is selected from the group consisting of a thiourea, a dithiocarbamate, and a polydithiocarbamate.

4. The solution of claim 1 wherein said hydrocarbon refinery unit is an atmospheric overhead condenser system.

5. A solution in a hydrocarbon refinery unit comprising:

a product stream, at least a portion of which has a highly turbulent velocity, wherein said product stream comprises;

dissolved carbon dioxide; and a composition for inhibiting corrosion of metal surfaces in said hydrocarbon refinery unit by said product stream, said composition comprising a ratio of about 6:1 of a pyridinium quaternary salt and an organic sulfur containing compound, said pyridinium quaternary salt having the following composition:

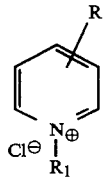

wherein

R is a methyl group substituted at the 2 or 3 position; and $R_1$ is selected from the group consisting of a methyl group, an allyl group, or an alkaryl group, and wherein said organic sulfur containing compound has the following structure:

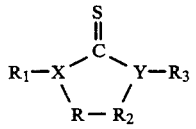

wherein

X and Y are selected from the group consisting of nitrogen, sulfur, and oxygen;

R, $R_1$, $R_2$ and $R_3$ are selected from the group consisting of a hydrogen, a cyclic or linear alkyl group, an allyl group, an aryl group, an alkaryl group, or an aralkyl group, provided that, when X and/or Y is oxygen or sulfur, each of said oxygen or sulfur has only one of said R groups.

6. The solution of claim 5 wherein said hydrocarbon refinery unit is an atmospheric overhead condenser system.

7. A method for inhibiting corrosion of metal surfaces in a hydrocarbon refinery unit which is exposed to a product stream containing dissolved carbon dioxide and having highly turbulent velocities comprising substantially continuously treating said solution with an additive resulting in a solution comprising between about 30–70 ppm of a pyridinium quaternary salt and between about 5–13 ppm of an organic compound containing sulfur double bonded to carbon, wherein said organic sulfur containing compound has the following structure:

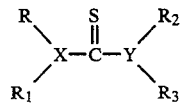

wherein

X and Y are selected from the group consisting of nitrogen, sulfur, and oxygen;

R, $R_1$, $R_2$ and $R_3$ are selected from the group consisting of a hydrogen, a cyclic or linear alkyl group, an allyl group, an aryl group, an alkaryl group, or an aralkyl group; provided that when X and/or Y is oxygen or sulfur, each of said oxygen or sulfur has only one of said R groups attached.

8. The method of claim 7 wherein said solution comprises between about 56–70 ppm of a pyridinium quaternary salt and between about 10–13 ppm of said organic sulfur containing compound.

9. The method of claim 7 wherein said pyridinium quaternary salt has the following composition:

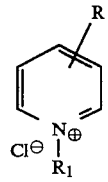

wherein

R may be substituted on the pyridine ring at the 2, 3, or 4 position, and R is selected from the group consisting of a hydrogen, an alkyl group having 1–3 carbon atoms, an aryl group, an alkaryl group, and an aralkyl group; and $R_1$ is selected from the group consisting of hydrogen, an alkyl group, an allyl group, an aryl group, an aryl group, an alkaryl group, or an aralkyl group.

10. The method of claim 9 wherein

R is a methyl group substituted at the 2 or 3 position; and $R_1$ is selected from the group consisting of a methyl group, an allyl group, or an alkaryl group.

11. The method of claim 10 wherein $R_1$ is a benzyl group in said pyridinium quaternary salt.

12. The method of claim 7 wherein R and $R_2$ are linear alkyl or allyl groups which connect to form a cyclic compound having the following structure:

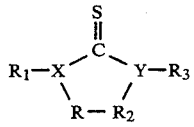

wherein

X and Y are selected from the group consisting of nitrogen, sulfur, and oxygen;

R, $R_1$, $R_2$ and $R_3$ are selected from the group consisting of a hydrogen, a cyclic or linear alkyl group, an allyl group, an aryl group, an alkaryl group, or an aralkyl group, provided that, when X and/or Y is oxygen or sulfur, each of said oxygen or sulfur has only one of said R groups.

13. The method of any one of claims 7, 8, 9, 10, or 11 wherein said organic sulfur containing compound is selected from the group consisting of a thiourea, a dithiocarbamate, and a polydithiocarbamate.

14. The method of claim 7 wherein said hydrocarbon refinery unit is an atmospheric overhead condenser system.

15. The method of claim 9 wherein said hydrocarbon refinery unit is an atmospheric overhead condenser system.

* * * * *

UNITED STATES PATENT AND TRADEMARK OFFICE

CERTIFICATE OF CORRECTION

PATENT NO. : 5,368,774
DATED : November 29, 1994
INVENTOR(S) : Borgard et al.

It is certified that error appears in the above-indentified patent and that said Letters Patent is hereby corrected as shown below:

At column 3, line 49, please delete "they same" and insert therefor -- the same --.

At column 3, line 49, please delete "or the" and insert therefor -- or they --.

In the formula at column 4, line 66, please delete " + $HCO_3^{31}$ " and insert therefor -- + $HCO_3^-$ --.

Signed and Sealed this
Eleventh Day of June, 1996

*Attest:*

*Attesting Officer*

BRUCE LEHMAN

*Commissioner of Patents and Trademarks*